US010342351B2

(12) United States Patent
Lenhart

(10) Patent No.: US 10,342,351 B2
(45) Date of Patent: Jul. 9, 2019

(54) FOLDABLE CHAIR

(71) Applicant: LEKISPORT AG, Baar (CH)

(72) Inventor: Markus Sebastian Lenhart, Kirchheim (DE)

(73) Assignee: LEKISPORT AG, Baar (CH)

( * ) Notice: Subject to any disclaimer, the term of this patent is extended or adjusted under 35 U.S.C. 154(b) by 37 days.

(21) Appl. No.: 15/518,015

(22) PCT Filed: Sep. 24, 2015

(86) PCT No.: PCT/EP2015/072006
§ 371 (c)(1),
(2) Date: Apr. 10, 2017

(87) PCT Pub. No.: WO2016/055280
PCT Pub. Date: Apr. 14, 2016

(65) Prior Publication Data

US 2017/0311723 A1 Nov. 2, 2017

(30) Foreign Application Priority Data

Oct. 8, 2014 (CH) ..... 1533/14

(51) Int. Cl.
*A47C 4/28* (2006.01)
*A47C 4/30* (2006.01)
(Continued)

(52) U.S. Cl.
CPC ..... *A47C 4/28* (2013.01); *A47C 4/286* (2013.01); *A47C 4/30* (2013.01); *A47C 4/38* (2013.01); *A47C 4/42* (2013.01); *A47C 9/105* (2013.01)

(58) Field of Classification Search
CPC .. A47C 4/28; A47C 4/286; A47C 4/30; A47C 4/38; A47C 4/42; A47C 4/34; A47C 9/105
(Continued)

(56) References Cited

U.S. PATENT DOCUMENTS 4,605,261 A * 8/1986 Lee ..... A47C 4/286 297/16.1
5,709,428 A * 1/1998 Hugghins ..... A47C 4/283 135/127
(Continued)

FOREIGN PATENT DOCUMENTS

DE 331 630 C 1/1921
DE 10 2011 054 611 A1 5/2012

OTHER PUBLICATIONS

International Preliminary Report on Patentability and Translation of Written Opinion, dated Apr. 20, 2017, from the International Bureau in counterpart International application No. PCT/EP2015/072006.
(Continued)

*Primary Examiner* — Mark R Wendell
(74) *Attorney, Agent, or Firm* — Sughrue Mion, PLLC

(57) ABSTRACT

The invention relates to a portable chair (1) having two front chair legs (2, 3), two rear chair legs (4, 5), two front chair arms (6, 7), two rear chair arms (8, 9), and two connection elements which are connected via a connection rod. The front chair legs and the rear chair legs each have a free end (2*a*, 3*a*, 4*a*, 5*a*) which is oriented towards an underlying surface (10), and the front chair arms and rear chair arms each have a free end (8*c*, 9*c*) which is oriented towards a seat surface (11) that is defined or can be defined by free ends (6*a*, 7*a*) of the front chair arms and free ends of the rear chair arms (8, 9).

22 Claims, 7 Drawing Sheets

(51) Int. Cl.

| | |
|---|---|
| ***A47C 4/38*** | (2006.01) |
| ***A47C 4/42*** | (2006.01) |
| *A47C 9/10* | (2006.01) |

(58) Field of Classification Search
USPC ..... 297/16.2, 16.1
See application file for complete search history.

(56) References Cited

U.S. PATENT DOCUMENTS

| | | | | |
|---|---|---|---|---|
| 8,454,084 | B2 * | 6/2013 | Lah | A47C 9/105 297/16.2 |
| 9,351,578 | B2 * | 5/2016 | Homans | A47C 4/30 |
| 9,930,966 | B2 * | 4/2018 | Yang | A47C 4/42 |
| 2009/0230736 | A1 * | 9/2009 | Homans | A47C 4/02 297/16.2 |
| 2012/0104805 | A1 | 5/2012 | Lah | |

OTHER PUBLICATIONS

International Search Report of PCT/EP2015/072006 dated Dec. 10, 2015.

* cited by examiner

FOLDABLE CHAIR

CROSS REFERENCE TO RELATED APPLICATIONS

This application is a National Stage of International Application No. PCT/EP2015/072006 filed Sep. 24, 2015, claiming priority based on Swiss Patent Application No. 01533/14 filed Oct. 8, 2014, the contents of all of which are incorporated herein by reference in their entirety.

TECHNICAL FIELD

The present invention relates to a portable, foldable chair, in particular for outdoor use, for example for camping, hiking, etc.

PRIOR ART

In the outdoor field, lightweight furniture is very popular, in particular foldable chairs, tables and beds. U.S. Pat. No. 5,709,428 discloses a foldable chair with a bracing rod which is mounted on a connecting piece via a quarter-turn quick-release fastener. The chair legs and chair arms in this case are all fastened individually by one respective resilient cord to the connecting piece via an eye. The production of such a chair is costly and the stability is unsatisfactory, in particular for a high body weight, due to the individually fastened legs and arms and the individual bracing rod.

DESCRIPTION OF THE INVENTION

The object of the present invention is to provide an improved foldable chair which has a greater internal stability and which is also suitable for use by people of high body weight. The chair is intended, on the one hand, to be easily produced but also to be able to be easily assembled and folded up. Additionally the chair is intended to have a packing size which is as small as possible.

This object is achieved by a chair as claimed in claim 1.

A portable chair according to the invention has two front chair legs and two rear chair legs, as well as two front chair arms and two rear chair arms. Here, the front chair legs and the rear chair legs in each case have a free end which is respectively oriented toward a substrate and/or downwardly toward the ground, i.e. away from the seat surface. The front chair arms and rear chair arms in each case have a free end which is oriented toward a seat surface and/or upwardly. This seat surface is able to be spanned and/or is spanned over the free ends of the front chair arms and the free ends of the rear chair arms. The seat surface in this case may be formed by a textile woven fabric or a woven or braided cloth, respectively, which, for example, may be slipped over the free ends by means of pockets at its corners or may be fastened to the free ends by means of shaped parts on the cloth (for example pointed parts or caps made of plastics or leather). In this case, one possibility is for the cloth to be mounted as a separate element during assembly of the chair. As an alternative to a releasable fastening, the seat surface may also be fixedly mounted at the free ends and, when folded up, folded up together with the chair arms and chair legs. Possible materials of the seat surface are woven fabrics, which are coated or uncoated on one side or both sides and which are produced from natural fibers and/or plastics fibers. The woven fabrics may have different mesh sizes in some areas due to their weave density. Preferably, at least one region, preferably a plurality of regions, of the seat surface is/are configured from air-permeable mesh-woven fabric. According to the invention, the front chair legs and the front chair arms are fastened to and/or in a first front connection element and the rear chair legs and the rear chair arms are fastened to and/or in a second rear connection element.

The first front connection element is connected via at least one (first) connection rod to the second rear connection element. According to a particularly preferred exemplary embodiment, the chair has two connection rods which connect the first front connection element to the second rear connection element. In this case, the two connection rods are preferably arranged parallel to one another and above one another, wherein the second connection rod is arranged parallel to and above the first connection rod. However, it is also possible to provide more than two connection rods, for example three or more connection rods in a triangular arrangement or in an arrangement increasing the stability between the two connection elements. For increasing the stability, the connection rods may also have corresponding cross sections, for example a circular, oval, angled, in particular rectangular or square, cross section. It is particularly advantageous if the front chair legs and the rear chair legs, as well as the front chair arms and the rear chair arms, are designed in each case as a tubular portion. Preferably, the two front chair legs are connected together via a first resilient cord which extends through the two tubular portions of the two chair legs. Similarly, the two rear chair legs are preferably connected together via a second resilient cord as well as the two front chair arms via a third resilient cord and the two rear chair arms via a fourth resilient cord. This permits simple assembly of the chair without multiple individual parts, due to the tension in the resilient cord, and it is possible to prevent individual parts from becoming mislaid after dismantling the chair.

The resilient cord, which in each case connects together the two front chair legs or the two front chair arms, and/or the two rear chair legs and/or the two rear chair arms, respectively, is advantageously guided through the respective two chair legs or chair arms and/or through the respective tubular portion of the respective two chair legs or chair arms connected together and is guided through the respective front or rear connection element between the respective tubular portions connected together, wherein the resilient cord in the respective connection element is deflected in the direction thereof.

Preferably, in each case two resilient cords are guided and deflected in the front connection element and in the rear connection element, wherein preferably the first resilient cord and the third resilient cord are guided in the front connection element and the second resilient cord and the fourth resilient cord are guided in the rear connection element. Thus the front two chair legs and the front two chair arms are fastened in the front connection element and the rear two chair legs and the rear two chair arms are fastened in the rear connection element.

According to a particularly preferred embodiment, the front chair legs are arranged at an acute angle to one another. For the purpose of this application, the relevant acute angle is less than 90 degrees, preferably between 40 and 90 degrees. Similarly, the rear chair legs are preferably arranged at an acute angle to one another, wherein these two angles are advantageously of substantially the same size, preferably 50-80 degrees, in particular preferably 60-70 degrees. The front chair arms are preferably also arranged at an acute angle to one another. This angle between the front chair arms is preferably greater than the angle defined between the front chair legs, in particular preferably 80-85 degrees. The rear chair arms are advantageously also arranged at an acute angle to one another, wherein this angle is preferably less than the angle defined between the front chair arms, preferably 45-50 degrees, in particular when the rear chair arms are configured to be longer than the front chair arms which means that the chair has a seat backrest.

According to a particularly preferred embodiment, the first front connection element and the second rear connection element have two respective lower tubular sleeves for receiving two chair legs and two upper tubular sleeves for receiving two chair arms. In this case a particularly preferred embodiment is characterized in that the first front connection element and the second rear connection element each have two respective central tubular sleeves extending from a first side to a second side of the connection element, and arranged above one another, for receiving a first lower connection rod and a second upper connection rod. Preferably, the respective connection element is configured in one piece, for example made of thermoplastics with or without fiber reinforcement by means of, for example, carbon fibers or glass fibers or made of composite material or as a light metal component.

The first opening of the respective lower tubular sleeve, which is oriented downwardly toward the substrate and which is suitable for receiving a chair leg, is preferably larger than the upwardly oriented second opening of the respective lower tubular sleeve. Similarly, preferably the second opening of the respective upper tubular sleeve, which is oriented upwardly toward the seat surface and which is suitable for receiving a chair arm, is larger than the first downwardly oriented upper opening of the respective upper tubular sleeve. The second upper opening of the respective lower tubular sleeve and the first lower opening of the respective upper tubular sleeve are suitable for guiding through it a resilient cord which in each case connects together two chair legs or two chair arms. The upper tubular sleeves for the chair arms are connected together at the respective connection element, preferably at their lower end, by a first lower reinforcing rib and at their upper end by a second upper reinforcing rib. In this case, the lower tubular sleeves for the chair legs are preferably integrally formed on at least one of these reinforcing ribs, advantageously both on the upper and on the lower reinforcing rib.

Preferably, the rear chair arms are longer than the front chair arms. When the chair arms are covered with a textile web and/or a cloth, this makes it possible for a seat backrest to be formed, the back of the user being able to rest thereagainst in order to relieve the load therefrom. For this purpose, the rear chair arms are preferably made up of at least two tubular portions which are able to be axially telescoped into one another and/or inserted into one another (in the axial direction of the respective rear chair arm). According to a particularly preferred embodiment, these respective two tubular portions of the rear chair arms are connected together via an adapter element. The adapter element preferably has a lower region which is received in a first lower tubular portion of the rear chair arm and an upper region which is received in an upper tubular portion of the rear chair arm. Preferably, the adapter element has an axial through-opening and/or through-bore which is suitable for receiving a resilient cord. This resilient cord then not only extends through the two tubular portions of the respective rear chair arm, but also through the axial through-opening of the adapter element connecting the two tubular portions.

The chair legs at their free end facing the substrate have a terminal stop, a (first or second) free end of a resilient cord being fastened thereon and/or therein. The terminal stop is then inserted and/or press-fitted into the lower end of the chair leg, wherein a lower circulating flange preferably provides the lower stop for the tubular portion of the chair leg. The terminal stop is advantageously fastened at its end facing the substrate in and/or on a foot. In this case, the terminal stop (and thus preferably also the lowermost end of the chair leg) may be received in a blind hole of this foot and fastened there, for example by bonding or press-fitting. Similarly, the chair arms at their free ends in each case preferably also have a terminal stop, the respective free end of the resilient cord being fastened or anchored therein and/or thereon, respectively, and which forms the upper terminal portion of the respective chair arm.

The foot may be configured, for example, from rubber or a rubber mixture, or from a thermoplastic or a thermoplastic elastomer. The foot may also have a radial ring, for example made of spaced-apart radial fins, or may even be designed as a ski pole disk with a disk region and a hard tip. This enables the foldable chair to be placed on soft ground, wherein the ring and/or disk prevents the chair leg from sinking uncontrollably into the substrate, in that the bearing surface of the foot with the substrate is enlarged and effective stability is achieved by the integrally formed tip region.

According to a particularly preferred embodiment, the chair according to the invention is a foldable chair, wherein in a folded-up state the chair arms and chair legs extend along the connection rods or may be flapped down or folded onto the connection rods, respectively, wherein these connection rods are preferably fixed to or in the connection elements, respectively. The connection rods may, for example, be fixedly bonded, riveted and/or press-fitted and/or, for example, fastened to the respective connection element by a transverse screw. Alternatively, the connection rods are releasably fastened to or in the connection elements, respectively, and may be removed from the corresponding tubular sleeves when folding up the chair. In the case of a releasable connection, the elements are preferably connected together fixedly in terms of rotation.

When pulling apart the foldable chair frame, the respective chair arms and chair legs are removed by stretching the resilient cord out of the respective connection element, wherein the chair legs and chair arms are able to be placed around the connection elements, so that the chair legs and chair arms are placed onto the at least one connection rod and extend substantially parallel to the longitudinal axis thereof, so that a bundle is formed. In this case, the at least one connection rod may remain fastened to the two connection elements. However, it is also conceivable that the at least one connection rod is removed from the respective tubular sleeves. The resilient cord simplifies the construction of the chair, by the individual chair arms and chair legs being pulled by the restoring force of the resilient cord toward the connection element.

A particularly practical chair according to the invention has at least one fastening region which is suitable for fastening accessories, such as for example a drinks holder or a bag, to the chair. This type of fastening region is independent of the sub-structure of the chair, i.e. from the type of construction of the chair arms and chair legs and the connection elements thereof and may, for example, be achieved by a complementary closure means arranged on the chair, which is capable of adhering to a complementary counterpart of the closure means on the accessory. It is particularly preferred if the accessory is able to be fastened by a hook-loop closure to the chair, wherein the chair has a Velcro strip portion and the accessory to be fastened thereto has the complementary hook strip (or vice versa). Alternatively, the fastening may take place, for example, via a latching closure or a buckle closure. In the case of a drinks holder, this may have at its lower end a spacer fastened to a chair arm, in addition to its preferred fastening of the upper region thereof to the textile material of the seat surface of the chair, which permits an upright storage of the drinks holder on the chair. This preferably rigid spacer may, for example, be looped over the chair arm by means of an eye or through-opening at its end opposing the drinks holder. This permits an additional securing of the fastening of the drinks holder to the chair if the fastening in the upper region of the drinks holder fails. The type of fastening of the accessory, for example of the drinks holder, is independent of the sub-structure of the chair, i.e. of the type of construction of the chair arms and chair legs and the connection elements thereof and may therefore also be implemented in other embodiments of a foldable chair.

In particular, it may be advantageous to provide a bag as a storage bag for stowing the folded-up chair, which in the state of use of the chair may then be fastened to the chair by means of such fastening means, for example may be fastened below the seat surface. This may be implemented on one of the two sides of the chair or in the rear region of the seat surface. Preferably, however, this storage bag is fastened in the front region of the seat surface, in particular preferably on the left-hand and right-hand front corner of the seat surface, for example by a latching closure or buckle closure. This bag may also be used as a carry bag, for example by means of a length-adjustable belt, with or without the chair folded up therein. The type of fastening of the storage bag or the use thereof is independent of the sub-structure of the chair, i.e. of the type of construction of the chair arms and chair legs and the connection elements thereof.

Further exemplary embodiments are disclosed in the dependent claims.

BRIEF DESCRIPTION OF THE DRAWINGS

Preferred embodiments of the invention are disclosed hereinafter with reference to the drawings, which merely serve for explanation and are not to be interpreted as limiting. In the drawings:

in FIG. 10*c*) a schematic view of the foot of FIG. 10*a*) from below; in FIG. 10*d*) a perspective view of the foot of FIG. 10*a*);

DESCRIPTION OF PREFERRED EMBODIMENTS

Figure 1:
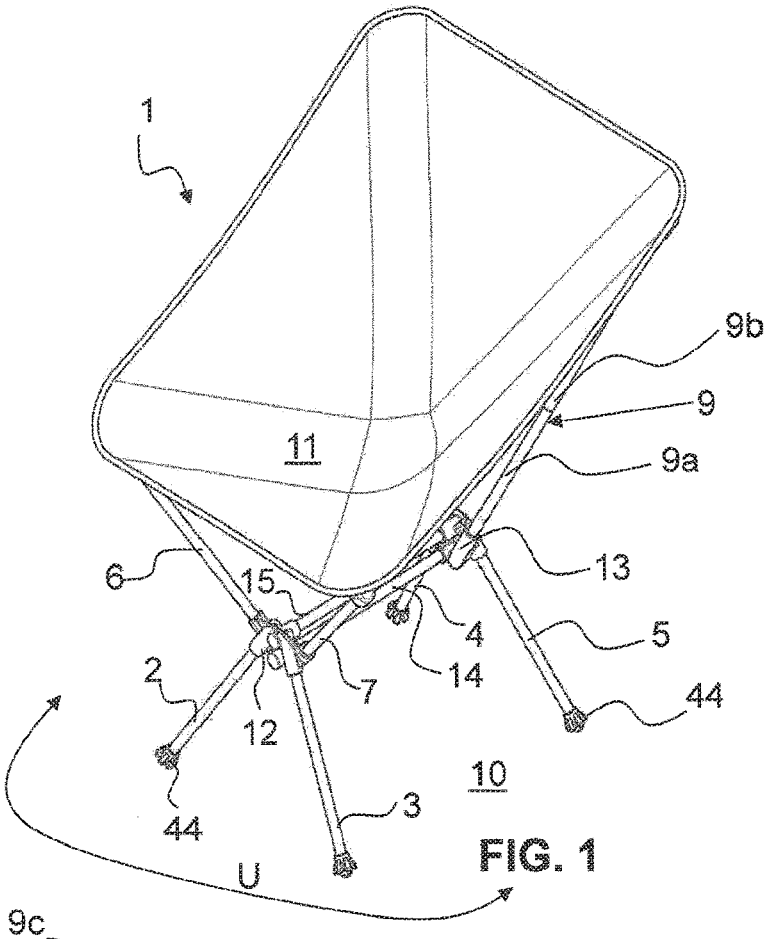
FIG. 1 shows a perspective view of a portable chair or foldable chair, respectively, according to a first preferred embodiment of the present invention.

A foldable chair according to a first preferred embodiment of the present invention is shown in FIG. 1. Said foldable chair has two front chair legs 2, 3 and two rear chair legs 4, 5, as well as two front chair arms 6, 7 and two rear chair arms 8, 9. The chair legs 2, 3, 4, 5 have in each case a free end 2*a*, 3*a*, 4*a*, 5*a* facing downwardly or facing the substrate 10 or the ground, respectively, in each case a foot, which for example may be configured as a ferrule, being fastened thereto. The chair arms 6, 7, 8, 9 in each case have a free end 6*a*, 7*a*, 8*c*, 9*c* facing away from the substrate 10 or upwardly, respectively. A seat surface 11 is spanned over these free ends 6*a*, 7*a*, 8*c*, 9*c*, said seat surface preferably providing the user with a seat support and a seat backrest. As shown in the present exemplary embodiment, a seat backrest is permitted by the rear chair arms 8, 9 being configured to be longer than the front chair arms 6, 7. In the exemplary embodiment shown in FIG. 1 this is implemented by the rear chair arms 8, 9 being configured in multiple parts, wherein two rod portions or tubular portions are axially inserted inside one another. In the present exemplary embodiment, the seat surface 11 is formed from a woven textile material. The seat surface is preferably formed from a combination of individual portions of different types of material which may consist of natural fibers or plastics fibers and which may also have different functions (for example air-permeability) or patterns. The textile cloth in this case is slipped over the free ends 6*a*, 7*a*, 8*c*, 9*c* of the chair arms 6, 7, 8, 9 by means of small pockets fastened thereto on the corners thereof on the lower face. The front chair legs 2, 3 and the front chair arms 6, 7 are fastened to a front connection element 12 and the rear chair legs 4, 5 and the rear chair arms 8, 9 are fastened to a rear connection element 13. In the preferred exemplary embodiment shown in FIG. 1, the two connection elements 12, 13 are connected together via two connection rods 14, 15 arranged above one another and parallel to one another, along their respective longitudinal axis L14 or L15, respectively.

In this case each connection element 12, 13 has six tubular sleeves 26-37 which are fastened thereto and which serve for receiving the respective chair legs 2, 3 or 4, 5, or chair arms 6, 7 or 8, 9 and connection rods 14, 15, respectively. The front connection element 12 has a left-hand lower tubular sleeve 26 for receiving the left-hand front chair leg 2, as well as a right-hand lower tubular sleeve 27 for receiving the right-hand front chair leg 3. Similarly, the front connection element 12 has a left-hand upper tubular sleeve 28 for receiving the left-hand front chair arm 6 as well as a right-hand upper tubular sleeve 29 for receiving the right-hand front chair arm 7. The four tubular sleeves 26, 27, 28, 29 for receiving the front chair legs 2, 3 and the front chair arms 6, 7 are substantially connected together via a plate 20 which at the same time serves as a reinforcing rib 38, 39 between the respective two lower tubular sleeves 26, 27 or the respective upper tubular sleeves 28, 29, respectively.

The rear connection element 13 has a left-hand lower tubular sleeve 30 for receiving the left-hand rear chair leg 4 as well as a right-hand lower tubular sleeve 31 for receiving the right-hand rear chair leg 5. Similarly, the rear connection element 13 has a left-hand upper tubular sleeve 32 for receiving the left-hand rear chair arm 8 as well as a right-hand upper tubular sleeve 33 for receiving the right-hand rear chair arm 9. The four tubular sleeves 30, 31, 32, 33 for receiving the rear chair legs 4, 5 and the rear chair arms 8, 9 are substantially connected together via a plate 21, which at the same time serves as a reinforcing rib 38, 39 between the two respective lower tubular sleeves 30, 31 or the respective upper tubular sleeves 32, 33, respectively.

Figure 2:
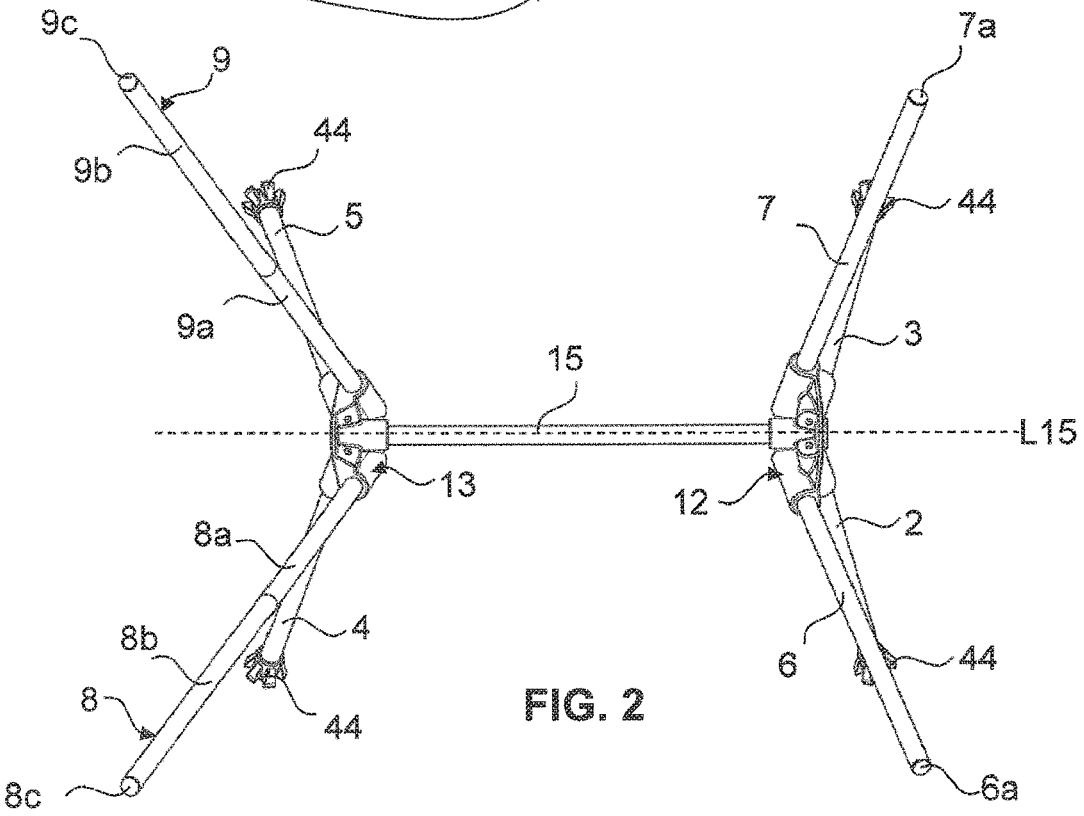
FIG. 2 shows a schematic view from above of the chair frame of FIG. 1 (chair without seat surface)

In this case, the left-hand lower tubular sleeve 26 and the right-hand lower tubular sleeve 27 are oriented on a front side 22 of the plate 20 or of the front connection element 12, respectively, toward the front and the left-hand upper tubular sleeve 28 and the right-hand upper tubular sleeve 29 are oriented on a rear side 23 of the plate 20 or of the front connection element 12, respectively, toward the rear. In contrast, the left-hand lower tubular sleeve 30 and the right-hand lower tubular sleeve 31 on a rear side 25 of the plate 21 or of the rear connection element 13, respectively, are oriented toward the rear and the left-hand upper tubular sleeve 32 and the right-hand upper tubular sleeve 33 on a front side 24 of the plate 21 or of the rear connection element 13, respectively, are oriented toward the front. As may be seen in FIG. 2 in the view from above, this has the result that in the exemplary embodiment shown the articulation of the chair legs 2, 3, 4, 5 on the chair 1 is arranged further to the outside in the peripheral direction U of the chair than the articulation of the chair arms 6, 7, 8, 9.

Additionally, each connection element 12, 13 has two central tubular sleeves 34, 35 or 36, 37, respectively, arranged above one another and parallel to one another for receiving one respective end of a connection rod 14, 15 which connects the front connection element 12 to the rear connection element 13. These central tubular sleeves 34, 35 or 36, 37, respectively, are arranged transversely to the direction of extension of the plate 20, 21 or to the plane of the plate 20, 21 of the respective connection element 12, 13, respectively, or pass through the plate 20, 21 to a certain extent, respectively. On the front face 22 of the front connection element 12 and on the rear face 25 of the rear connection element 13 the central tubular sleeves 34, 35 or 36, 37, respectively, are closed in the exemplary embodiment shown. The two connection rods 14, 15 extend along their longitudinal axes L14, L15 from the front to the rear and are arranged above one another, spaced apart from one another, forming an intermediate space 48.

Figure 3:
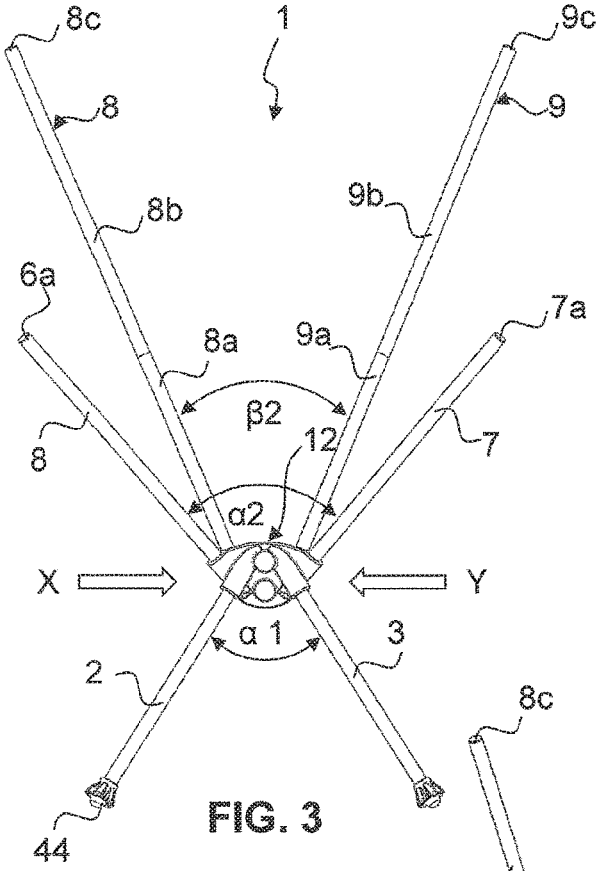
FIG. 3 shows a schematic view from the front (from the entry side, in the viewing direction V of FIG. 4) of the chair frame of FIG. 1.
Figure 4:
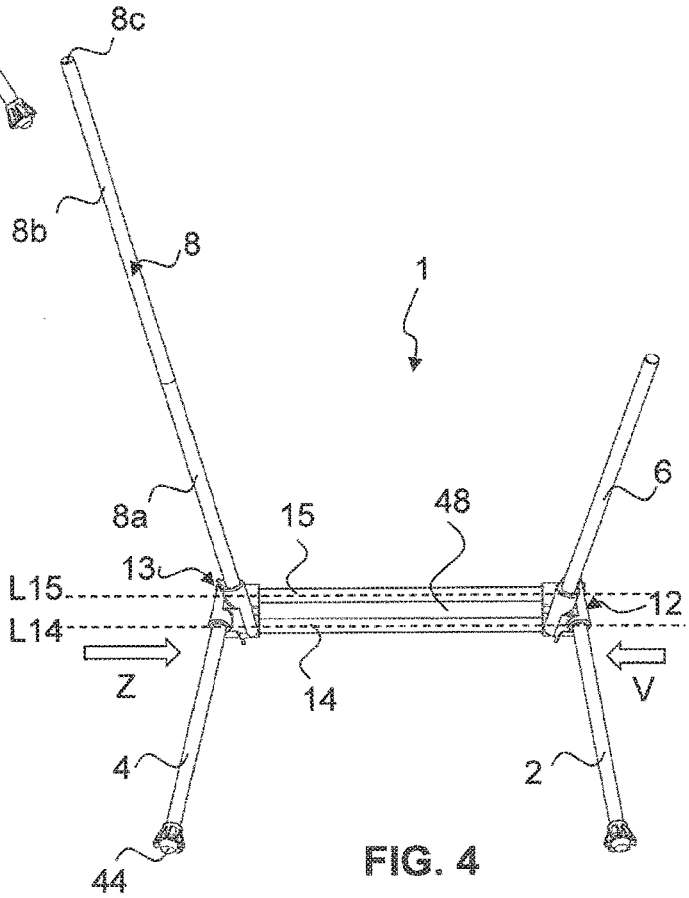
FIG. 4 shows a schematic view from the left (in the viewing direction X of FIG. 3) of the chair frame of FIG. 3.

The front chair legs 2, 3 and rear chair legs 4, 5 are arranged in each case at an acute angle $\alpha 1$ (first acute angle), $\beta 1$ (third acute angle) to one another, which in the present exemplary embodiment is about 60-70 degrees. The front chair arms 6, 7 are also arranged at an acute angle $\alpha 2$ (second acute angle) to one another which is larger than the angle $\alpha 1$ spanned between the front chair legs 2, 3 and in the present exemplary embodiment of FIG. 3 is 80-85 degrees. The rear chair arms 8, 9 which in the present exemplary embodiment of FIG. 3 substantially span the seat backrest, are arranged at an acute angle $\beta 2$ (fourth acute angle) to one another, wherein this angle $\beta 2$ is smaller than the angle $\alpha 2$ spanned between the front chair arms 6, 7 in the present exemplary embodiment, and in the exemplary embodiment of FIG. 3 is 45-50 degrees.

Figure 5:
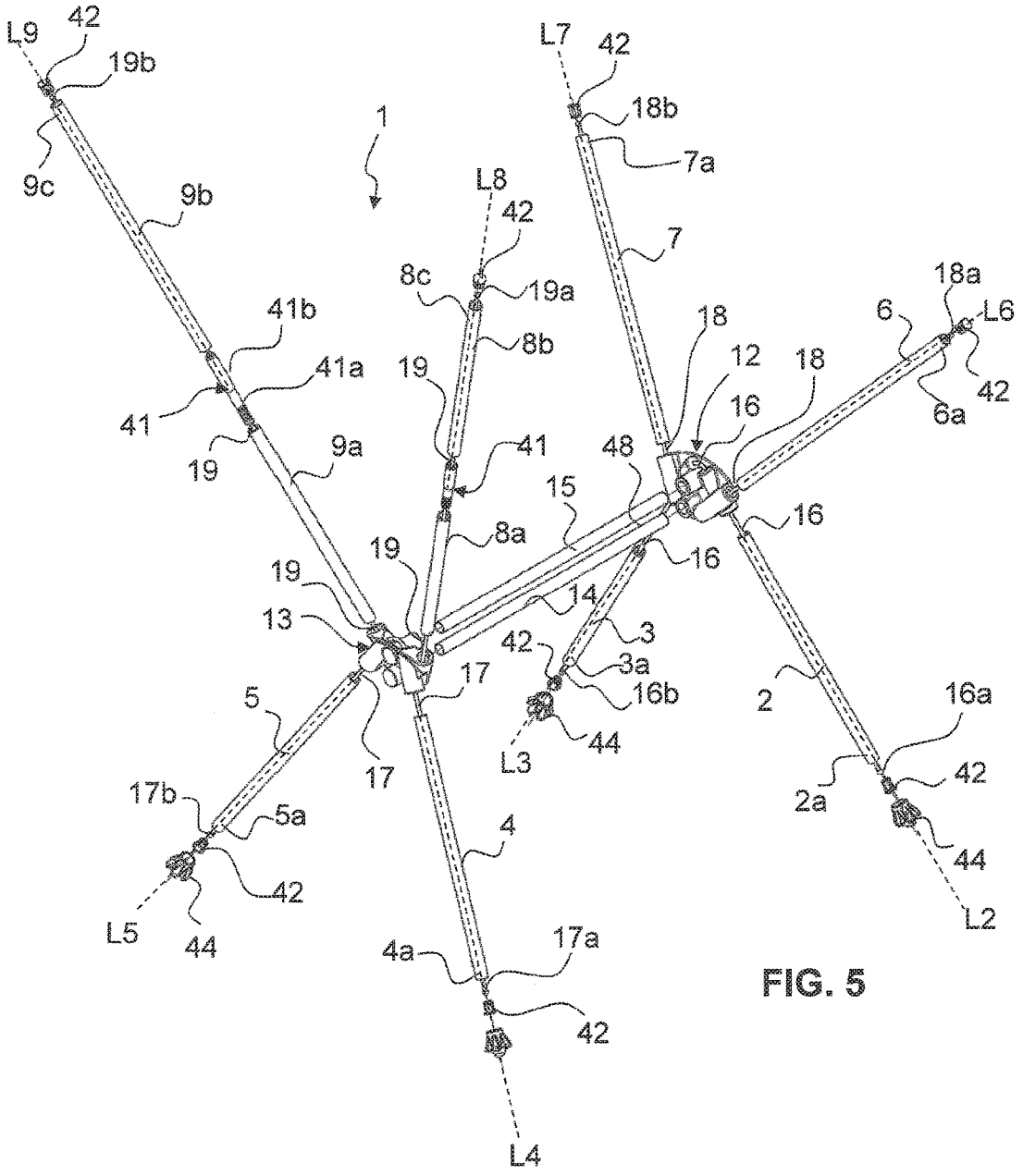
FIG. 5 shows an exploded view of the chair frame of FIG. 3.
Figure 9:
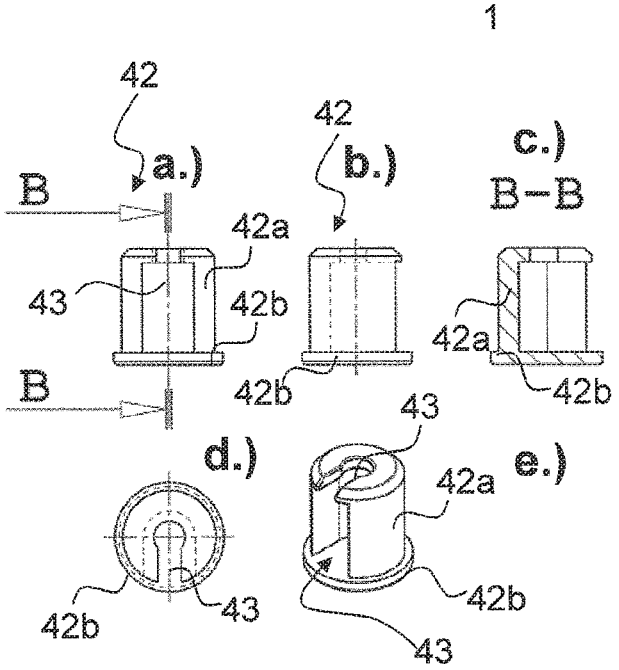
FIG. 9 shows in 9*a*) a schematic view of a terminal stop of the chair of FIG. 1 from the front; in 9*b*) a schematic view of the terminal stop of FIG. 9*a*) from the side; in 9*c*) a sectional view through the line B-B of FIG. 9*a*); in 9*d*) a schematic view of the terminal stop of FIG. 9*a*) from above; in 9*e*) a perspective view of the terminal stop of FIG. 9*a*)

In the exploded view of FIG. 5 it may be seen that in each case two chair legs 2, 3 or 4, 5, respectively, and in each case two chair arms 6, 7 or 8, 9, respectively, are connected together in each case by a resilient cord. The chair 1 has four such resilient cords in the exemplary embodiment shown of FIG. 5. In this case, each resilient cord 16, 17, 18, 19, which is guided through a chair leg 2, 3, 4, 5 or a chair arm 6, 7, 8, 9, is deflected in the connection element 12, 13 in order to enter at this point the chair leg 2, 3, 4, being adjacent with respect to the peripheral direction U of the chair 1, or the chair arm 6, 7, 8, 9, respectively, being adjacent with respect to the the peripheral direction U of the chair 1, which is articulated to the same connection element 12, 13. Each resilient cord 16, 17, 18, 19 in this case has two ends 16*a*, 16*b*, 17*a*, 17*b*, 18*a*, 18*b*, 19*a*, 19*b*. Each of these ends is anchored in a terminal stop 42, as illustrated in FIG. 5. The terminal stop 42 in this case has a cylindrical portion 42*a* which has a hollow space and/or a recess 43 and is provided on its side facing the periphery with a base which has a peripheral flange 42 which bears against the end of the respective chair leg or chair arm and closes the tubular portion of the respective chair leg or chair arm. The resilient cord 16, 17, 18, 19 has at its two ends 16*a*, 16*b*, 17*a*, 17*b*, 18*a*, 18*b*, 19*a*, 19*b*, for example, a knot which during assembly is inserted into the recess 43 of the terminal stop 42, as shown in FIG. 9, and comes to bear in a tapered portion of the recess 43, wherein the resilient cord is able to enter through the tapered recess into the respective tubular portion.

Figure 10:
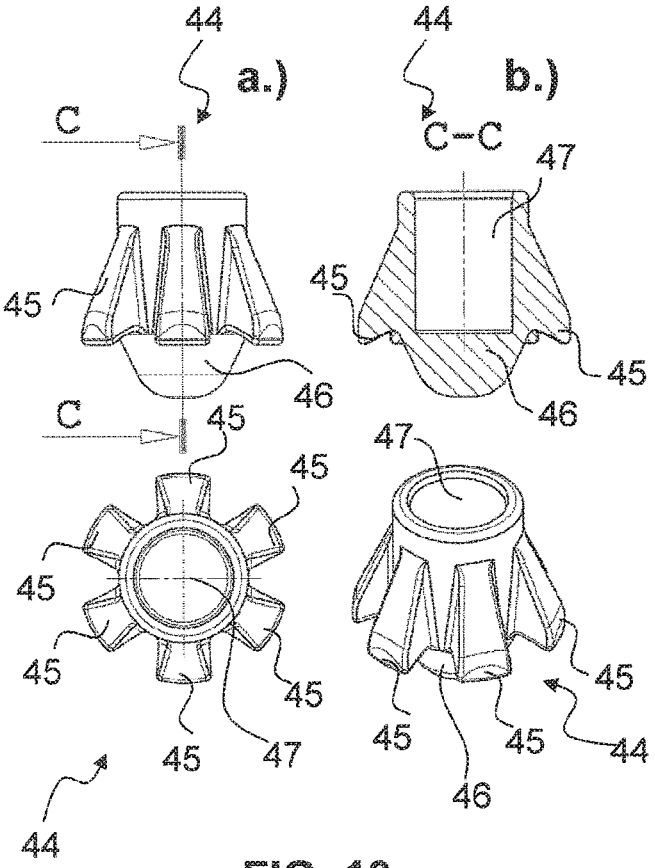
FIG. 10 shows in 10*a*) a schematic view of a foot of the chair of FIG. 1; in 10*b*) a sectional view through the line C-C of FIG. 10*a*)

The terminal stop 42 on the chair arms 6, 7, 8, 9 forms the terminal portion or the upper end respectively, of the chair arm 6, 7, 8, 9. Additionally a foot 44 is mounted on the chair legs 2, 3, 4, 5 via the end of the respective chair leg 2, 3, 4, 5 closed by the terminal stop 42. In this case the end of the chair leg 2, 3, 4, is received in a blind hole 47 of the foot and fastened therein, for example fixedly bonded or press-fitted thereon. The foot 44 shown in FIG. 10 also has a tip 46 for supporting the chair 1 on the substrate 10. The foot 44 also has a ring consisting of a plurality of radial fins 45 which extend radially outwardly at regular intervals from one another and enlarge the bearing surface of the foot 44 with the substrate 10. This is particularly useful in soft substrates, such as for example on forest soil, where the tip 46 sinks into the ground. The shape and design of the feet may be constructed to be variable and to be replaceable according to the type of ground.

In the exemplary embodiment shown, the rear chair arms 8, 9 are in each case configured from two tubular portions 8*a*, 8*b* or 9*a*, 9*b*, respectively, as described above and shown particularly clearly in the exploded view of FIG. 5. Said tubular portions are connected together in each case by an adapter element 41, which in each case has an upper portion 41*b* and a lower portion 41*a*. The upper portion 41*b* of the adapter element 41 in this case is inserted into the upper tubular portion 8*b*, 9*b*, whilst the lower portion 41*a* is inserted into the lower tubular portion 8*a*, 9*a* of the respective rear chair arm 8, 9. The diameter of the upper portion 41*b* is larger than the diameter of the lower portion 41*a*, so that the lower tubular portion 8*a*, 9*a* with its upper end comes to bear against the shoulder 41*d*, toward the upper portion 41*b* of the adapter element 41.

Figure 6:
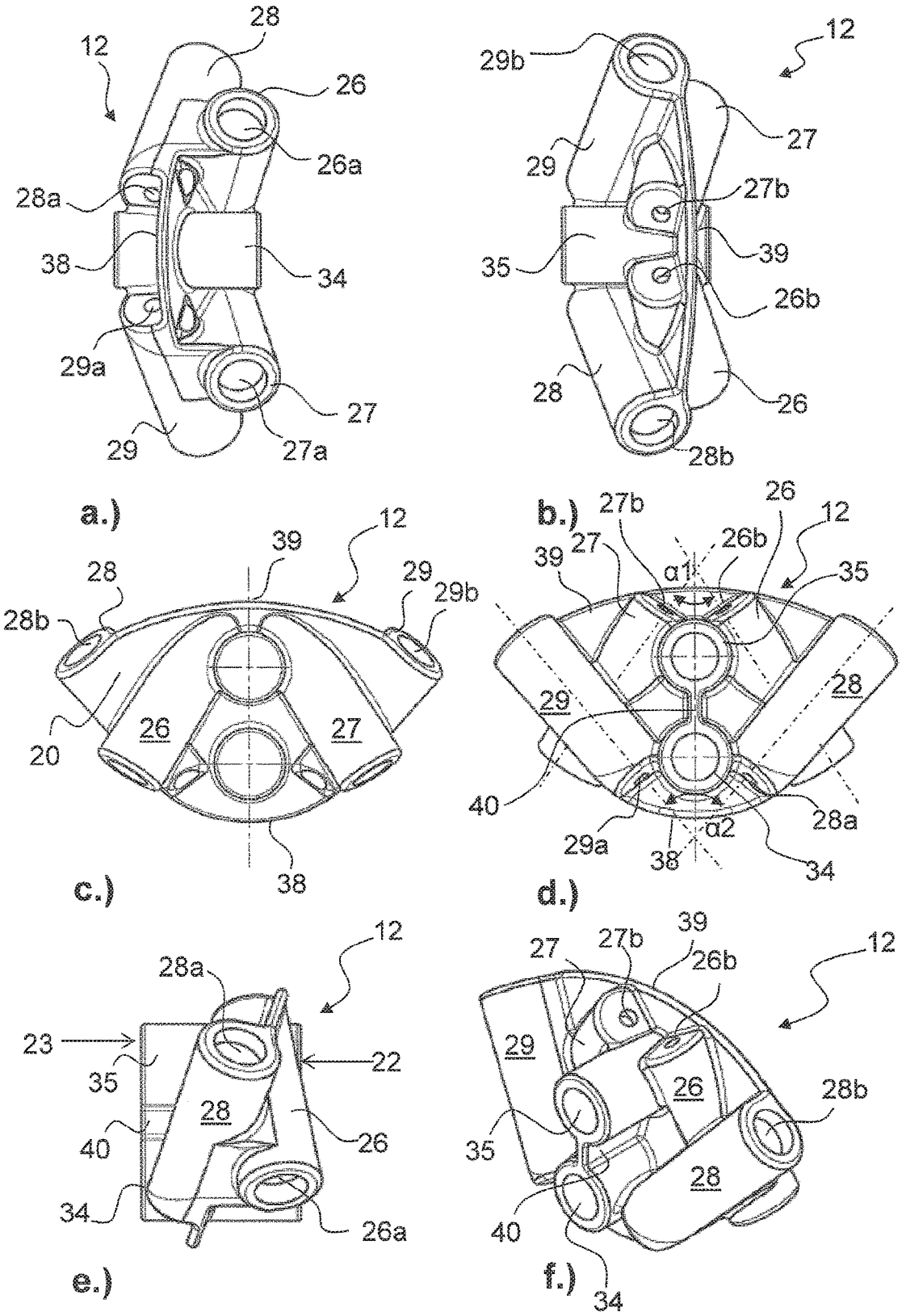
FIG. 6 shows different schematic views of the front connection element of the chair of FIG. 1, including in FIG. 6*a*) from below (from the substrate), in FIG. 6*b*) from above (from the seat surface), in FIG. 6*c*) from the front, in FIG. 6*d*) from the rear (from the backrest side in the viewing direction Z of FIG. 4), in FIG. 6*e*) from the left, in FIG. 6*f*) from the right (in the viewing direction Y of FIG. 3) in a perspective view.
Figure 7:
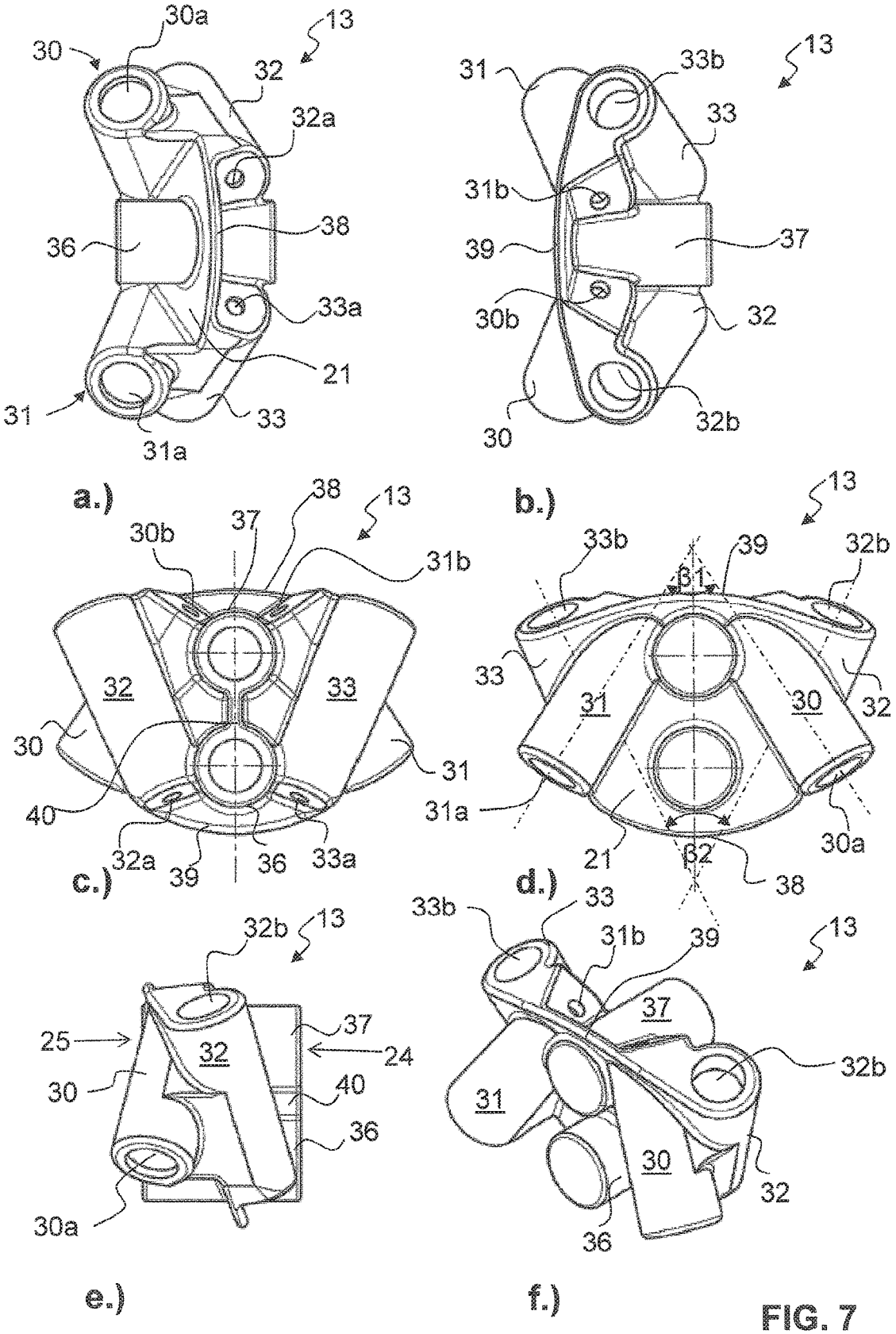
FIG. 7 shows different views of the rear connection element of the chair of FIG. 1, including in FIG. 7*a*) from below, in FIG. 7*b*) from above, in FIG. 7*c*) from the front, in FIG. 7*d*) from the rear, in FIG. 7*e*) from the left, in FIG. 7*f*) from the right in a perspective view.
Figure 8:
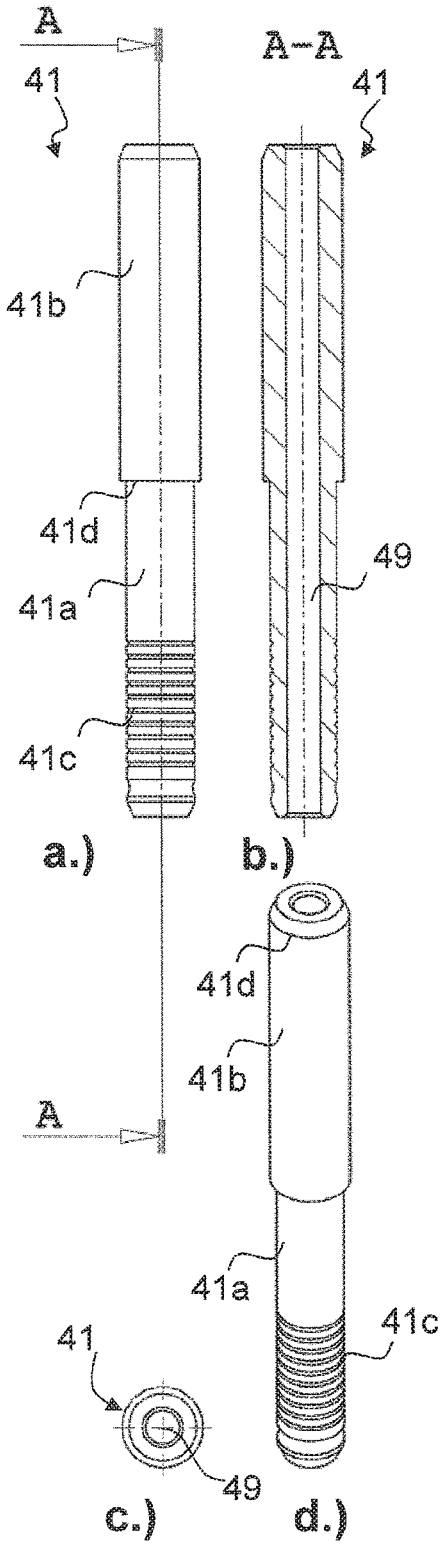
FIG. 8 shows in a) a schematic view of an adapter element of the chair of FIG. 1; in b) a sectional view through the line A-A of FIG. 8*a*); in c) a schematic view of the adapter element of FIG. 8*a*) from above; in d) a perspective view of the adapter element of FIG. 8*a;*

In the exemplary embodiment shown in FIGS. 5 and 8, the lower portion 41*a* has a ribbed region 41*c* or a ribbing, respectively, for improving the grip in the case of fastening by adhesive bonding in the lower tubular portion 8*a*, 9*a*. The upper end and the lower end of the adapter element 41 are configured to extend slightly conically. So that the resilient cord 19 may be guided through the respective adapter element 41, the adapter element has an axial through-opening and/or through-bore 49 which has only a slightly larger diameter than the diameter of the resilient cord 19. The front connection element 12 is shown in more detail in FIG. 6 and the rear connection element 13 is shown in more detail in FIG. 7.

Each connection element 12, 13 forms in a manner of speaking a tuberous element with six tubular sleeves 26, 27, 28, 29, 34, 35 or 30, 31, 32, 33, 36, 37, respectively. In this case, the upper tubular sleeves 28, 29, 32, 33 for the chair arms 6, 7, 8, 9 at their lower end are connected together by a first or lower reinforcing rib 38, respectively, and at their upper end by a second or upper reinforcing rib 39, respectively. The lower tubular sleeves 26, 27, 30, 31 for the chair legs 2, 3, 4, 5 are then so to speak integrally formed on these reinforcing ribs 38, 39. The tubular sleeves 26, 27, 30, 31 for the chair legs 2, 3, 4, 5 pass through the respective upper reinforcing rib 39. As a result, the upper end of the respective tubular sleeve 26, 27, 30, 31 comes to bear against the opposing side of the respective upper reinforcing rib 39 compared to the lower end of the respective tubular sleeve 26, 27, 30, 31. Thus, the upper openings 26*b*, 27*b* of the front chair leg tubular sleeves 26, 27 are arranged on the rear face 23 of the front connection element 12, and the lower openings 26*a*, 27*a* are arranged on the front face 22 of the front connection element 12. The upper openings 30*b*, 31*b* of the rear chair leg tubular sleeves 30, 31 are correspondingly arranged on the front face 24 of the rear connection element 13 and the lower openings 30*a*, 31*a* on the rear face 25. In other words, on a left-hand side and on a right-hand side of the front and the rear connection elements 12, 13 in each case an upper tubular sleeve 28, 29, 32, 33 intersects with a lower tubular sleeve 26, 27, 30, 31.

The connection element 12, 13 has the approximate appearance of being formed from a plate 20, 21 (which forms the reinforcing ribs), six tubular sleeves being integrally formed thereon, wherein the plate substantially extends in a direction transversely to the direction of extension L14, L15 of the connection rods 14, 15 in the plane spanned by the respective chair arms 6, 7, 8, 9 at the angle $\alpha 2$ or $\beta 2$, respectively. The plate 20, 21 in this case has substantially the shape of a circular sector.

The reinforcing rib 40, which is configured so to speak as a web between the two central tubular sleeves 34, 35, is visible in FIG. 6*d*, said reinforcing rib extending on the rear face 23 of the first front connection element 12 substantially transversely to the longitudinal axis of the connection rods 14, 15. Similarly, in FIG. 7*c* the reinforcing rib 40 extends between the two central tubular sleeves 34, 35 on the front face 24 of the second rear connection element 13 substantially transversely to the longitudinal axis L14, L15 of the connection rods 14, 15.

The type of path of the resilient cord 17 is explained hereinafter by way of example with reference to the two rear chair legs 4, 5 but expediently also applies to the type of path for the other three resilient cords 16, 18, 19 (with the exception that the resilient cord 19 is longer than the others and extends through two respective tubular portions 8*a*, 8*b* and/or 9*a*, 9*b* of the rear chair arms 8, 9 and therebetween through an adapter element).

As is visible in the exploded view of FIG. 5, the resilient cord 17 extends from the anchoring thereof with its first end 17*a* in the terminal stop 42 of the left-hand rear chair leg 4 through the tubular portion of the rear chair leg. The rear chair leg 4 on the rear connection element 13 enters into the lower opening 30*a* of the left-hand lower tubular sleeve 30 (shown in detail in FIG. 7) and the resilient cord 17 passes through the upper opening 30*b* out of the rear connection element 13, where its direction is deflected, and passes through the upper opening 31*b* of the right-hand lower tubular sleeve 31 into the tubular portion of the right-hand rear chair leg 5. The resilient cord 17 then extends through the right-hand rear chair leg 5 until at its second end 17*b* it is anchored again in a terminal stop 42 of the right-hand rear chair leg 5.

Figure 11:
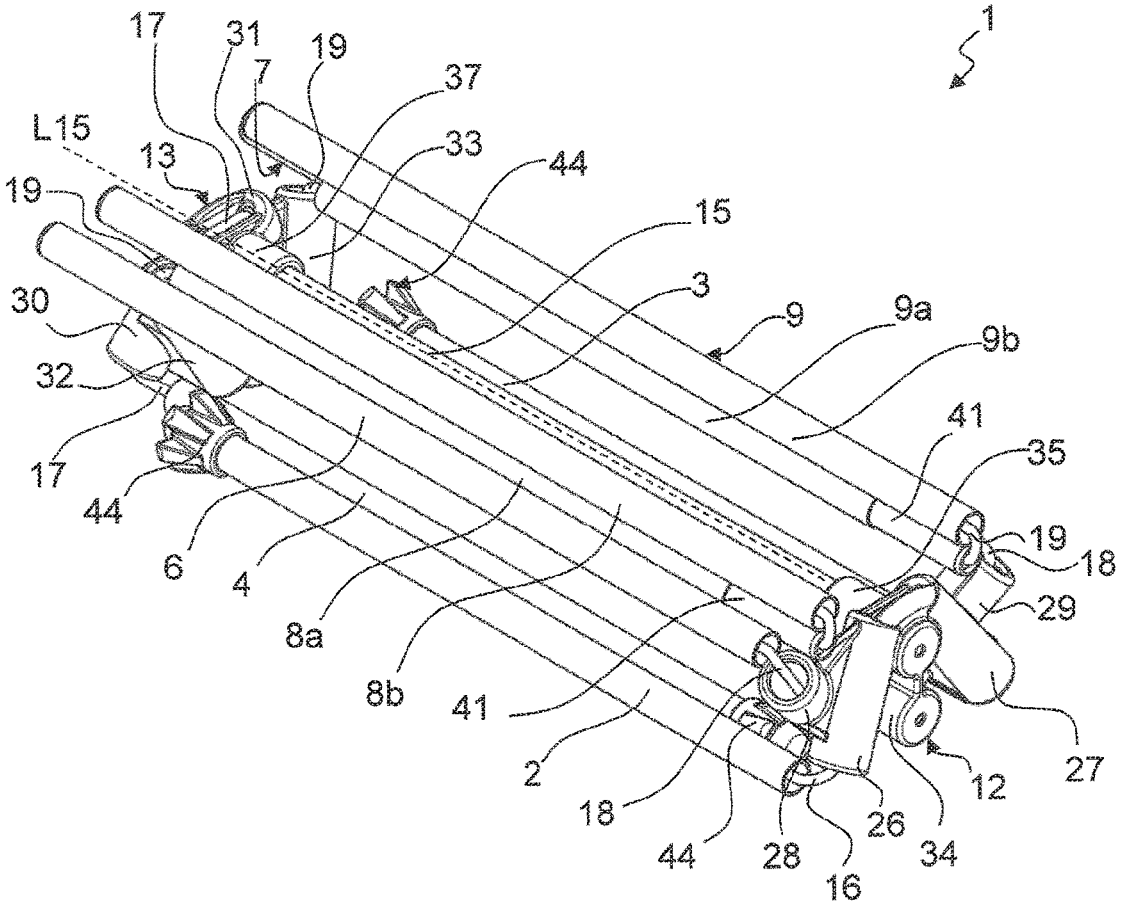
FIG. 11 shows a schematic view of the chair frame of FIG. 1 in the folded-up state.

In FIG. 11 a chair 1 according to the invention is shown in the folded-up state. When folding up the chair 1 the two connection rods 14, 15 remain connected to the respective connection element 12, 13 and the respective two chair legs 2,3/4,5 and chair arms 6,7/8,9 are pulled out of the respective tubular sleeve 26,27/28,29/30,31/32,33 and placed parallel to the longitudinal axis L14, L15 of the connection rods 14, 15. When placed together, the upper tubular portions 8*b*, 9*b* and lower tubular portions 8*a*, 9*a* of the chair arms 8, 9 are additionally separated from one another in that the respective upper tubular portion 8*b*, 9*b* of the chair arms 8, 9 is separated from the respective adapter element 41. In this case the respective lower tubular portion 8*a*, 9*a* and the lower region 41*a* of the adapter element remain in the lower tubular portion 8*a*, 9*a*.

LIST OF REFERENCE NUMERALS

1 Foldable chair
2 Left-hand front chair leg
2*a* Free end of 2
3 Right-hand front chair leg
3*a* Free end of 3
4 Left-hand rear chair leg
4*a* Free end of 4
5 Right-hand rear chair leg
5*a* Free end of 5
6 Left-hand front chair arm
6*a* Free end of 6
7 Right-hand front chair arm
7*a* Free end of 7
8 Left-hand rear chair arm
8*a* First, lower tubular portion of 8
8*b* Second, upper tubular portion of 8
8*c* Free end of 8
9 Right-hand rear chair arm
9*a* First, lower tubular portion of 9
9*b* Second, upper tubular portion of 9
9*c* Free end of 9
10 Substrate
11 Seat surface
12 First, front connection element
13 Second, rear connection element
14 First, lower connection rod
15 Second, upper connection rod
16 First resilient cord

16*a* First end of 16
16*b* Second end of 16
17 Second resilient cord
17*a* First end of 17
17*b* Second end of 17
18 Third resilient cord
18*a* First end of 18
18*b* Second end of 18
19 Fourth resilient cord
19*a* First end of 19
19*b* Second end of 19
20 Plate of 12
21 Plate of 13
22 First, front side of 12
23 Second, rear side of 12
24 First, front side of 13
25 Second, rear side of 13
26 Left-hand lower tubular sleeve of 12
26*a* First lower opening of 26
26*b* Second upper opening of 26
27 Right-hand lower tubular sleeve of 12
27*a* First, lower opening of 27
27*b* Second, upper opening of 27
28 Left-hand upper tubular sleeve of 12
28*a* First, lower opening of 28
28*b* Second, upper opening of 28
29 Right-hand upper tubular sleeve of 12
29*a* First, lower opening of 29
29*b* Second, upper opening of 29
30 Left-hand lower tubular sleeve of 13
30*a* First, lower opening of 30
30*b* Second, upper opening of 30
31 Right-hand lower tubular sleeve of 13
31*a* First lower opening of 31
31*b* Second upper opening of 31
32 Left-hand upper tubular sleeve of 13
32*a* First, lower opening of 32
32*b* Second, upper opening of 32
33 Right-hand upper tubular sleeve of 13
33*a* First, lower opening of 33
33*b* Second, upper opening of 33
34 Lower central tubular sleeve of 12 for 14
35 Upper central tubular sleeve of 12 for 15
36 Lower central tubular sleeve of 13 for 14
37 Upper central tubular sleeve of 13 for 15
38 Lower reinforcing rib
39 Upper reinforcing rib
40 Central reinforcing rib
41 Adapter element
41*a* Lower region of 41
41*b* Upper region of 41
41*c* Ribbed region of 41*a*
41*d* Shoulder between 41*a*, 41*b*
42 Terminal stop
42*a* Cylindrical region of 42
42*b* Peripheral flange of 42
43 Recess in 42
44 Foot
45 Fin of 44
46 Tip of 44
47 Blind hole in 44
48 Intermediate space between 14, 15
49 Axial through-opening of 41
$\alpha$1 First acute angle between 2, 3
$\alpha$2 Second acute angle between 6, 7
$\beta$1 Third acute angle between 4, 5
$\beta$2 Fourth acute angle between 8, 9
L2 Longitudinal axis of 2, 26
L3 Longitudinal axis of 3, 27
L4 Longitudinal axis of 4, 30
L5 Longitudinal axis of 5, 31
L6 Longitudinal axis of 6, 28
L7 Longitudinal axis of 7, 29
L8 Longitudinal axis of 8, 32
L9 Longitudinal axis of 9, 33
L14 Longitudinal axis of 14
L15 Longitudinal axis of 15
U Peripheral direction of 1
U Peripheral direction of 1
V Viewing direction from the front
X Viewing direction from the left
Y Viewing direction from the right
Z Viewing direction from the rear

The invention claimed is:

1. A portable chair comprising:

two front chair legs and two rear chair legs, as well as two front chair arms and two rear chair arms, wherein the front chair legs and the rear chair legs each have a free end which is oriented toward a substrate, wherein the front chair arms and rear chair arms in each case have a free end which is oriented toward a seat surface, wherein the seat surface is able to be spanned or is spanned over free ends of the front chair arms and free ends of the rear chair arms, wherein the front chair legs and the front chair arms are fastened to and/or in a first, front connection element, wherein the rear chair legs and the rear chair arms are fastened to and/or in a second, rear connection element, wherein the first, front connection element is connected via at least one first connection rod to the second, rear connection element, wherein the first front connection element and the second rear connection element each have two respective lower tubular sleeves for receiving two chair legs and two upper tubular sleeves for receiving two chair arms, and wherein the upper tubular sleeves for the chair arms are connected together at their lower end by a first lower reinforcing rib and at their upper end by a second upper reinforcing rib.

2. A portable chair comprising:

two front chair legs and two rear chair legs, as well as two front chair arms and two rear chair arms, wherein the front chair legs and the rear chair legs each have a free end which is oriented toward a substrate, wherein the front chair arms and rear chair arms in each case have a free end which is oriented toward a seat surface, wherein the seat surface is able to be spanned or is spanned over free ends of the front chair arms and free ends of the rear chair arms, wherein the front chair legs and the front chair arms are fastened to and/or in a first, front connection element, wherein the rear chair legs and the rear chair arms are fastened to and/or in a second, rear connection element, wherein the first, front connection element is connected via at least one first connection rod to the second, rear connection element, wherein the rear chair arms are longer than the front chair arms, and wherein the rear chair arms are made up of at least two tubular portions which are able to be telescoped and/or inserted into one another.

3. The chair as claimed in claim 1 or 2, wherein the front chair legs and the rear chair legs as well as the front chair arms and the rear chair arms each are designed as a tubular portion and wherein the two front chair legs are connected together via a first resilient cord, wherein the two rear chair legs are connected together via a second resilient cord, wherein the two front chair arms are connected together via a third resilient cord and wherein the two rear chair arms are connected together via a fourth resilient cord.

4. The chair as claimed in claim 3, wherein each resilient cord is guided through the respective tubular portion of the respective two chair legs or chair arms connected together, and is guided through the respective front or rear connection element between the respective tubular portions connected together, and deflected there.

5. The chair as claimed in claim 3, wherein two resilient cords are guided and deflected in the front connection element and also in the rear connection element, and wherein the first resilient cord and the third resilient cord are guided in the front connection element and the second resilient cord and the fourth resilient cord are guided in the rear connection element.

6. The chair as claimed in claim 1 or 2, wherein the front chair legs are arranged at a first acute angle to one another and wherein the rear chair legs are arranged at a second acute angle to one another, and wherein the first acute angle between the front chair legs and also the second acute angle between the rear chair legs is 50-80 degrees.

7. The chair as claimed in claim 6, wherein the front chair arms are arranged at a third acute angle to one another which, however, is larger than the first acute angle defined between the front chair legs.

8. The chair as claimed in claim 7, wherein the third acute angle between the front chair arms is 80-85 degrees.

9. The chair as claimed in claim 6, wherein the rear chair arms are arranged at a fourth acute angle to one another, and wherein this fourth acute angle between the rear chair arms is smaller than the third acute angle defined between the front chair arms.

10. The chair as claimed in claim 9, wherein the fourth acute angle between the rear chair arms is 45-50 degrees.

11. The chair as claimed in claim 1 or 2, wherein the connection element is configured in one piece.

12. The chair as claimed in claim 1 or 2, wherein the chair legs at their free end facing the substrate have a terminal stop, a free end of a resilient cord being able to be fastened thereon and/or therein, wherein the terminal stop is fastened at its end facing the substrate in and/or on a foot.

13. The chair as claimed in claim 1 or 2, wherein the chair has at least one fastening region with a complementary closure means.

14. The chair as claimed in claim 13, wherein the chair has at least one fastening region with a hook-and-loop fastener strip, which is suitable for fastening accessories to the chair by means of a hook-loop closure.

15. The chair as claimed in claim 1 or 2, wherein the seat surface is configured from woven fabric, which is coated or uncoated on one side or on both sides and which is produced from natural fibers and/or plastics fibers.

16. The chair as claimed in claim 15, wherein the woven fabric has different mesh sizes in some areas, wherein at least one region of the seat surface is configured from air-permeable mesh-woven fabric.

17. The chair as claimed in claim 1 or 2, wherein the chair is a foldable chair, and wherein in a folded-up state the chair arms and chair legs extend along the at least one connection rod which is fastened fixedly to and/or in the connection elements or is able to be releasably fastened to and/or in the connection elements.

18. The chair as claimed in claim 1, wherein the first, front connection element is connected via at least two connection rods to the second, rear connection element, wherein a second connection rod is arranged parallel to and above the first connection rod, and wherein the first front connection element and the second rear connection element have two respective central tubular sleeves extending from a first side to a second side of the connection element and arranged on top of one another for receiving the first, lower connection rod and the second, upper connection rod.

19. The chair as claimed in claim 1, wherein the lower tubular sleeves for the chair legs are integrally formed on at least one of the reinforcing ribs.

20. The chair as claimed in claim 2, wherein the at least two tubular portions of the rear chair arms are connected together via an adapter element, wherein the adapter element is received in a lower region by a first, lower tubular portion of the rear chair arm and is received in an upper region by an upper tubular portion of the rear chair arm.

21. The chair as claimed in claim 20, wherein the adapter element has an axial through-opening which is suitable for receiving a resilient cord.

22. A portable chair comprising:

two front chair legs and two rear chair legs, as well as two front chair arms and two rear chair arms, wherein the front chair legs and the rear chair legs each have a free end which is oriented toward a substrate, wherein the front chair arms and rear chair arms in each case have a free end which is oriented toward a seat surface, wherein the seat surface is able to be spanned or is spanned over free ends of the front chair arms and free ends of the rear chair arms, wherein the front chair legs and the front chair arms are fastened to and/or in a first, front connection element, wherein the rear chair legs and the rear chair arms are fastened to and/or in a second, rear connection element, wherein the first, front connection element is connected via at least one first connection rod to the second, rear connection element, wherein the first, front connection element is connected via at least two connection rods to the second, rear connection element, wherein a second connection rod is arranged parallel to and above the first connection rod, wherein the first front connection element and the second rear connection element each have two respective lower tubular sleeves for receiving two chair legs and two upper tubular sleeves for receiving two chair arms, wherein the first front connection element and the second rear connection element have two respective central tubular sleeves extending from a first side to a second side of the connection element and arranged on top of one another for receiving the first, lower connection rod and the second, upper connection rod, wherein the first opening of the respective lower tubular sleeve which is downwardly oriented toward the substrate and which is suitable for receiving a chair leg is larger than the upwardly oriented second opening of the respective lower tubular sleeve, wherein the second opening of the respective upper tubular sleeve which is upwardly oriented toward the seat surface and which is suitable for receiving a chair arm is larger than the first, downwardly oriented opening of the respective upper tubular sleeve, and wherein the second, upper opening of the respective lower tubular sleeve and the first, lower opening of the respective upper tubular sleeve are suitable for passing through it a resilient cord which in each case connects together two chair legs or two chair arms.

* * * * *